US007640762B2

(12) United States Patent
Otsuka et al.

(10) Patent No.: US 7,640,762 B2
(45) Date of Patent: Jan. 5, 2010

(54) REFRIGERATION APPARATUS

(75) Inventors: Kaname Otsuka, Settsu (JP); Hiromichi Ueno, Settsu (JP); Kenichi Masaki, Settsu (JP); Kyo Tomikawa, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 490 days.

(21) Appl. No.: 10/570,326

(22) PCT Filed: Aug. 17, 2004

(86) PCT No.: PCT/JP2004/011770

§ 371 (c)(1),
(2), (4) Date: Mar. 2, 2006

(87) PCT Pub. No.: WO2005/024313

PCT Pub. Date: Mar. 17, 2005

(65) Prior Publication Data

US 2007/0017249 A1 Jan. 25, 2007

(30) Foreign Application Priority Data

Sep. 5, 2003 (JP) ..... 2003-313439

(51) Int. Cl.
*F25B 49/00* (2006.01)
*F25D 17/04* (2006.01)
*F25B 41/00* (2006.01)

(52) U.S. Cl. ..... 62/196.4; 62/197; 62/513

(58) Field of Classification Search ..... 62/196.4, 62/513, 175, 510

See application file for complete search history.

(56) References Cited

U.S. PATENT DOCUMENTS

| | | | | |
|---|---|---|---|---|
| 2,024,323 | A * | 12/1935 | Wyld | 62/510 |
| 2,463,881 | A * | 3/1949 | Kemler | 62/324.3 |
| 2,677,944 | A * | 5/1954 | Ruff | 62/192 |
| 2,897,659 | A * | 8/1959 | Wergner | 62/509 |
| 4,261,691 | A * | 4/1981 | Zimmern et al. | 417/440 |
| 4,602,485 | A * | 7/1986 | Fujimoto et al. | 62/174 |
| 6,058,727 | A * | 5/2000 | Fraser et al. | 62/190 |
| 6,167,722 | B1 | 1/2001 | Kasezawa et al. | |
| 2003/0010046 | A1 * | 1/2003 | Freund et al. | 62/222 |
| 2004/0035122 | A1 * | 2/2004 | Lifson et al. | 62/113 |
| 2005/0262859 | A1 * | 12/2005 | Crane et al. | 62/197 |
| 2009/0107173 | A1 * | 4/2009 | Yoon et al. | 62/510 |
| 2009/0235678 | A1 * | 9/2009 | Taras et al. | 62/115 |

FOREIGN PATENT DOCUMENTS

| | | |
|---|---|---|
| JP | 02-287058 | 11/1990 |
| JP | 04-060348 | 2/1992 |

(Continued)

*Primary Examiner*—Frantz F Jules
*Assistant Examiner*—Alexis K Cox
(74) *Attorney, Agent, or Firm*—Global IP Counselors

(57) ABSTRACT

A refrigeration apparatus includes two sub passages which are branched from a main passage located between a condenser and an expansion part and which are connected to a compressor. On the sub passages are provided supercooling-use expansion parts, and supercooling-use heat exchangers for performing heat exchange between a refrigerant on an outlet side of the supercooling-use expansion part and a refrigerant of the main passage. Therefore, each time the refrigerant of the main passage passes through the two supercooling-use heat exchangers the degree of liquid supercooling of the refrigerant is increased.

9 Claims, 3 Drawing Sheets

FOREIGN PATENT DOCUMENTS

| | | | |
|---|---|---|---|
| JP | 05-322334 | | 12/1993 |
| JP | 07-180917 | A | 7/1995 |
| JP | 09-210480 | | 8/1997 |
| JP | 11-248264 | | 9/1999 |
| JP | 2000-220893 | | 8/2000 |
| WO | WO-02/077543 | A1 | 10/2002 |

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2003-313439, filed in Japan on Sep. 5, 2003 the entire contents of which are hereby incorporated herein by reference.

BACKGROUND OF THE INVENTION

The present invention relates to a refrigeration apparatus in which, for example, a compressor, a condenser, an expansion part and an evaporator are connected to one another.

In a conventional refrigeration apparatus, a compressor, a condenser, an expansion valve and an evaporator are connected to one another in a loop, where a supercooling-use heat exchanger is placed between the condenser and the expansion valve. Then, a liquid refrigerant derived from the condenser is branched into two flows. One flow of the liquid refrigerant makes a main flow liquid, while the other flow of the liquid refrigerant, after passing through the supercooling-use heat exchanger, super-cools the main flow liquid via the supercooling-use heat exchanger, then being led to the compression chamber of the compressor (see, for example, JP H11-248264 A).

However, the prior art refrigeration apparatus is incapable of further increasing the degree of liquid supercooling of the refrigerant immediately before the expansion valve. Thus, there have been limitations in improving the refrigerating capacity and energy efficiency (COP).

SUMMARY OF THE INVENTION

Accordingly, an object of the present invention is to provide a refrigeration apparatus which is capable of further increasing the degree of liquid supercooling of the refrigerant immediately before the expansion part, thus enabled to improve the refrigerating capacity and energy efficiency (COP).

In order to achieve the objects, the refrigeration apparatus includes:

a compressor;

a condenser;

an expansion part; and an evaporator, wherein the compressor, the condenser, the expansion part and the evaporator are connected to one another in order, the refrigeration apparatus further includes:

at least two sub passages which are branched from a main passage located between the condenser and the expansion part and which are connected to the compressor;

supercooling-use expansion parts provided on the sub passages, respectively; and supercooling-use heat exchangers for performing heat exchange between a refrigerant on an outlet side of the supercooling-use expansion part and a refrigerant of the main passage.

In this refrigeration apparatus of the invention, since the supercooling-use heat exchanger is provided at least two in number along the main passage, the degree of liquid supercooling (SC) can be increased each time the refrigerant of the main passage passes through the plurality of supercooling-use heat exchangers.

That is, since the refrigeration apparatus of this invention has a so-called three- or more-stage expansion economizer cycle, the degree of liquid supercooling of the refrigerant immediately before the expansion part can be further increased so that the refrigerating capacity and energy efficiency (COP) can be further improved, as compared with prior-art refrigeration apparatuses having a two-stage expansion economizer cycle.

Moreover, in the refrigeration apparatus of one embodiment, the compressor is a single screw compressor including a screw rotor and a pair of gate rotors which mesh with the screw rotor so as to sandwich the screw rotor from both sides, and the sub passages are provided two in number, one of the sub passages being connected to one side of a boundary defined by the pair of gate rotors, and the other of the sub passages being connected to the other side of the boundary defined by the pair of gate rotors.

In the refrigeration apparatus of this one embodiment, since the sub passage and the supercooling-use heat exchanger are provided two in number, an economizer cycle can be applied to each of compression spaces divided by an boundary defined by the pair of gate rotors in the compressor. Thus, a so-called three-stage expansion economizer cycle becomes applicable, so that performance improvement can be achieved.

Moreover, in the refrigeration apparatus of one embodiment, the refrigeration apparatus includes:

a discharge-side supercooling control section for detecting temperature and pressure of the refrigerant on the discharge side of the compressor and, based on a result of the detection, performing control of an opening degree of the supercooling-use expansion part in one of the sub passages; and a suction-side supercooling control section for detecting temperature and pressure of the refrigerant on the suction side of the compressor in the other sub passage and, based on a result of the detection, performing control of an opening degree of the supercooling-use expansion part in the other sub passage.

In the refrigeration apparatus of this one embodiment, since one of the supercooling-use expansion parts is controlled by the discharge-side supercooling control section while the other supercooling-use expansion part is controlled by the suction-side supercooling control section, the two supercooling-use expansion parts can be controlled based on different temperatures and pressures, respectively.

Consequently, in the two supercooling-use expansion parts, hunting of the opening and closing operations due to control exerted based on a common temperature and pressure can be avoided so that a stable cooling effect can be obtained.

According to the refrigeration apparatus of the present invention, since the supercooling-use heat exchanger is provided at least two in number along the main passage, the degree of liquid supercooling of the refrigerant immediately before the expansion part can be increased so that the refrigerating capacity and energy efficiency can be improved.

Also, according to the refrigeration apparatus of one embodiment, since the economizer cycle is applied to each of the divisional compression spaces of the compressor, performance improvement can be achieved.

Also, according to the refrigeration apparatus of one embodiment, since the two supercooling-use expansion parts are controlled based on different temperatures and pressures, respectively, competition of the opening and closing operations between the two supercooling-use expansion parts can be prevented so that a stable cooling effect can be obtained.

BRIEF DESCRIPTION OF THE-DRAWINGS

DETAILED DESCRIPTION OF THE INVENTION

Hereinbelow, the present invention will be described in detail by embodiments thereof illustrated in the accompanying drawings.

Figure 1:
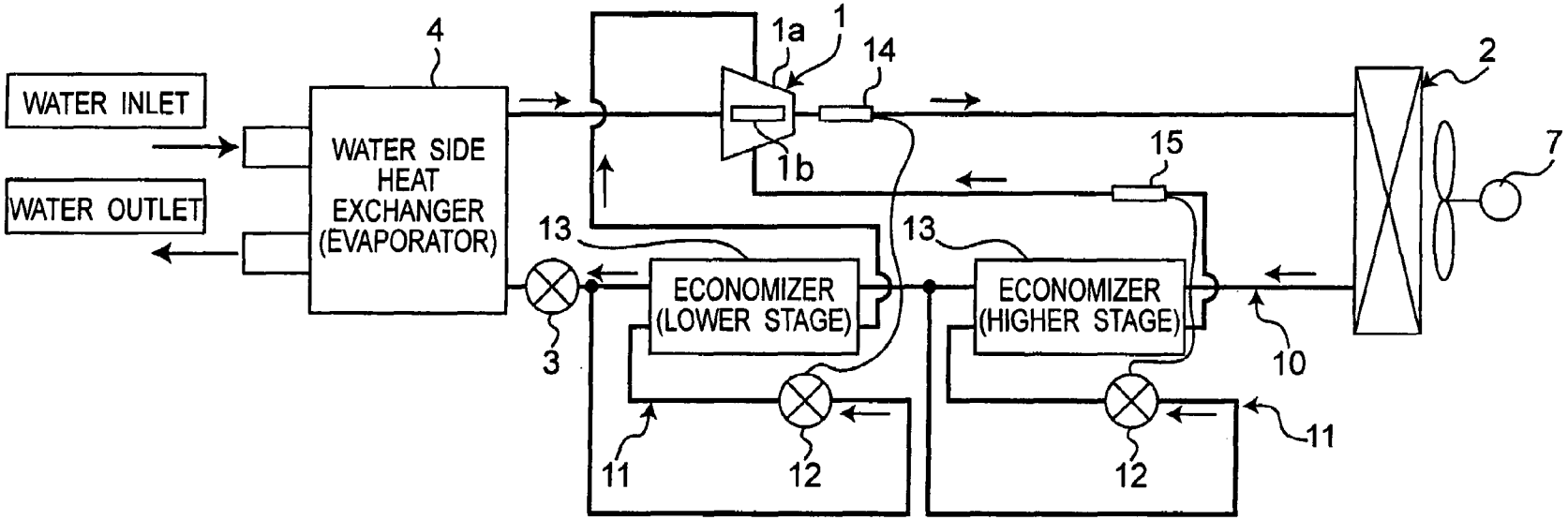
FIG. 1 is a simplified configurational view showing an embodiment of the refrigeration apparatus of the present invention.

FIG. 1 shows a simplified configurational view showing an embodiment of the refrigeration apparatus of the invention. In this refrigeration apparatus, a compressor 1, a condenser 2, an expansion part 3 and an evaporator 4 are connected to one another in a loop, constituting a refrigeration cycle using a refrigerant.

This refrigeration cycle is explained. A vapor phase refrigerant discharged by the compressor 1 has its heat absorbed in the condenser 2, resulting in a liquid phase state. The resulting liquid phase refrigerant is decompressed by the expansion part 3, resulting in a two-phase state of vapor phase and liquid phase. Thereafter, the two-phase refrigerant (wet gas) has heat imparted in the evaporator 4, resulting in a vapor phase state. The resulting vapor phase refrigerant is sucked and pressurized in the compressor 1, and then discharged in the compressor 1 again.

As the compressor 1, for example, a single screw compressor is used. In more detail, the compressor 1 includes a screw rotor 1*a*, and a pair of gate rotors 1*b*, 1*b* which meshes with the screw rotor 1*a* so as to sandwich the same from both sides. Meshing between a thread groove of the screw rotor 1*a* and tooth portions of the one pair of gate rotors 1*b*, 1*b* defines the compression chamber, and the refrigerant is compressed to high pressure in the compression chamber.

The condenser 2 includes a fan 7, and the refrigerant is cooled by air cooling of the fan 7. The expansion part 3 is given by using, for example, an electronically controlled expansion valve or a capillary tube. The evaporator 4 is given by using, for example, a heat exchanger for cooling water (liquid heat transfer medium) by the refrigerant.

Moreover, this refrigeration apparatus has two sub passages 11, 11 which are branched from a main passage 10 between the condenser 2 and the expansion part 3 and connected to the compressor 1. It is noted that the main passage 10 and the sub passages 11 are implemented by piping.

More specifically, by the branch from upstream and downstream sides of the main passage 10, an upstream-side sub passage 11 and a downstream-side sub passage 11 are formed. This upstream-side sub passage 11 is connected to one side of the pair of gate rotors 1*b*, 1*b*, which are assumed as a boundary, while the downstream-side sub passage 11 is connected to the other side of the pair of gate rotors 1*b*, 1*b* assumed as the boundary. That is, the upstream-side sub passage 11 communicates with a midway portion of the compression chamber located on one side of the boundary given by the pair of gate rotors 1*b*, 1*b*, while the downstream-side sub passage 11 communicates with a midway portion of the compression chamber located on the other side of the boundary given by the pair of gate rotors 1*b*, 1*b*.

Further, a supercooling-use expansion part 12 and a supercooling-use heat exchanger 13 for performing heat exchange between the refrigerant on the outlet side of the supercooling-use expansion part 12 and the refrigerant of the main passage 10 are provided on each of these sub passages 11.

More specifically, an upstream-side supercooling-use heat exchanger (higher-stage economizer) 13 and a downstream-side supercooling-use heat exchanger (lower-stage economizer) 13 are set along the main passage 10. In FIG. 1, although the sub passages 11 are branched from the main passage 10 on the downstream side of the supercooling-use heat exchanger 13, yet those sub passages 11 may also be branched from the main passage 10 on the upstream side of the supercooling-use heat exchanger 13.

Next, operation of the two supercooling-use heat exchangers 13, 13 is explained. The liquid phase refrigerant in the main passage 10, coming from the condenser 2, is first diverged to the upstream-side sub passage 11. This liquid phase refrigerant in the upstream-side sub passage 11 is decompressed by the supercooling-use expansion part 12, resulting in a two-phase refrigerant of vapor phase and liquid phase. The resulting two-phase refrigerant absorbs heat from the liquid phase refrigerant of the main passage 10 via the upstream-side supercooling-use heat exchanger 13, resulting in a vapor phase refrigerant. The resulting vapor phase refrigerant is sucked into the compressor 1. In this process, the liquid phase refrigerant in the main passage 10 is cooled via the upstream-side supercooling-use heat exchanger 13.

Thereafter, the cooled liquid phase refrigerant in the main passage 10 is diverged to the downstream-side sub passage 11. The liquid phase refrigerant in the downstream-side sub passage 11 is decompressed in the supercooling-use expansion part 12, resulting in a two-phase refrigerant of vapor phase and liquid phase. The resulting two-phase refrigerant absorbs heat from the liquid phase refrigerant of the main passage 10 via the downstream-side supercooling-use heat exchanger 13, resulting in a vapor phase refrigerant. The resulting vapor phase refrigerant is sucked into the compressor 1. In this process, the liquid phase refrigerant in the main passage 10 is cooled via the downstream-side supercooling-use heat exchanger 13.

According to the refrigeration apparatus having the above-described construction, since the two supercooling-use heat exchangers 13, 13 are provided, the refrigerant of the main passage 10 can be increased in the degree of liquid supercooling each time it passes through the two supercooling-use heat exchangers 13, 13.

That is, the refrigeration apparatus of this invention, by virtue of its having a three-stage expansion economizer cycle made up of the three expansion parts 3, 12, 12 and the two supercooling-use heat exchangers 13, 13, can be increased in the degree of liquid supercooling for the refrigerant immediately before the expansion part 3, thus capable of further improving the refrigerating capacity and energy efficiency (COP), as compared with the prior-art refrigeration apparatus having a two-stage expansion economizer cycle made up of two expansion valves and one supercooling-use heat exchanger.

Figure 2:
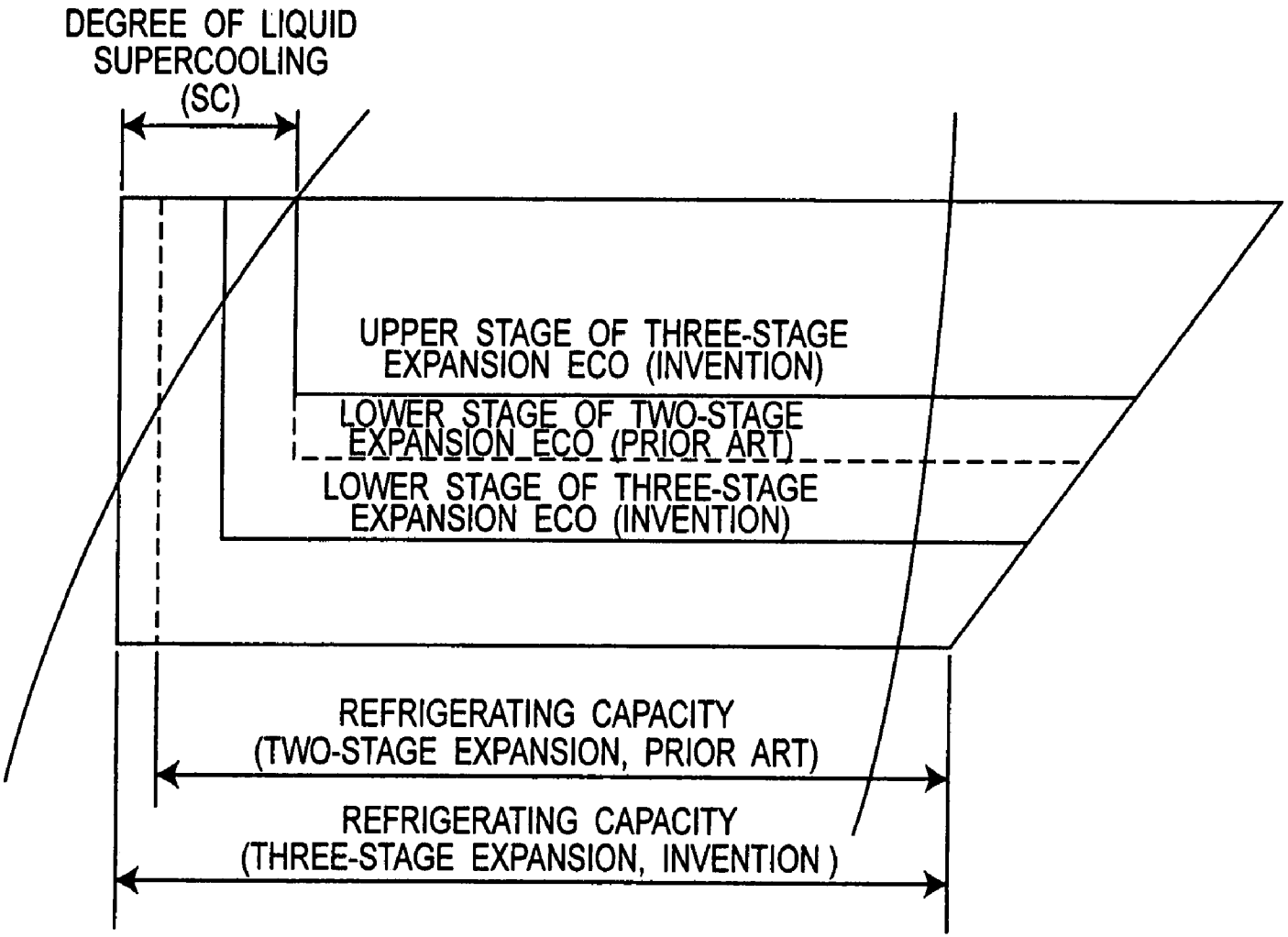
FIG. 2 is a PH diagram for comparison between the refrigeration apparatus of the invention and a refrigeration apparatus of a prior art.

More specifically, as shown in FIG. 2, in the refrigeration apparatus of the invention (three-stage expansion) indicated by solid line, the degree of liquid supercooling (SC) is increased by the upstream-side supercooling-use heat exchanger (upper stage of three-stage expansion ECO) and the downstream-side supercooling-use heat exchanger (lower stage of three-stage expansion ECO) so that the refrigerating capacity is improved, as compared with the refrigeration apparatus of the prior art (two-stage expansion) indicated by broken line.

Moreover, the refrigeration apparatus of the invention, as shown in FIG. 1, further includes a discharge-side supercooling control section 14 for detecting temperature and pressure of the refrigerant on the discharge side of the compressor 1 and, based on a result of the detection, performing control of the opening degree of the supercooling-use expansion part 12 in the downstream, and a suction-side supercooling control section 15 for detecting temperature and pressure of the refrigerant on the suction side of the compressor 1 in the upstream-side sub passage 11 and, based on a result of the detection, performing control of the opening degree of the supercooling-use expansion part 12 in the upstream.

More specifically, the discharge-side supercooling control section 14 performs the opening degree control by calculating a present-time current SH value from a temperature and a high-pressure pressure value of the refrigerant within discharge piping of the compressor 1 and then comparing the obtained value with a previously set target SH value. The suction-side supercooling control section 15 performs the opening degree control by calculating a present-time current SH value from a temperature and a pressure value of the refrigerant within outlet piping of the upstream-side supercooling-use heat exchangers 13 and then comparing the obtained value with a previously set target SH value. It is noted here that the SH value refers to a degree of superheat, which is a temperature showing a difference from the temperature of a saturated state.

The supercooling-use expansion part 12 is provided by using a temperature-sensitive expansion valve, thus allowing its price to be lowered as compared with the electronic expansion valve. Of course, an electronic expansion valve may also be used as the supercooling-use expansion part 12.

Figure 3:
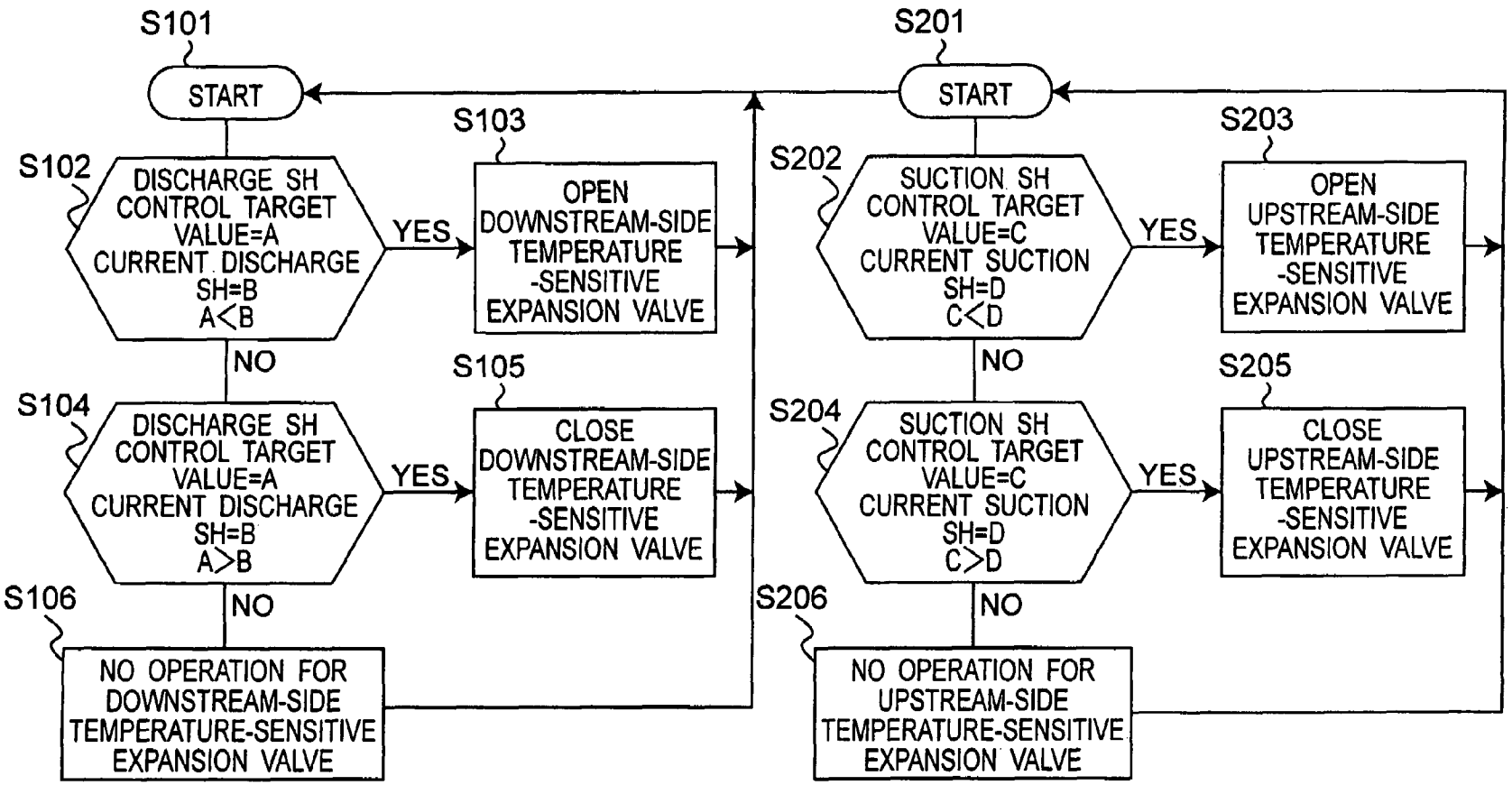
FIG. 3 is a flowchart showing the control of a discharge-side supercooling control section and a suction-side supercooling control section.

Next, referring to FIG. 3, operations of the discharge-side supercooling control section 14 and the suction-side supercooling control section 15 are explained.

First, control operation by the discharge-side supercooling control section 14 is described. As the control operation starts (S101), it is decided whether or not the current SH value (B) is greater than the target SH value (A) (S102). If it is greater, the control section 14 opens the downstream-side temperature-sensitive expansion valve 12 (S103). Conversely, if it is not greater, it is decided whether or not the current SH value (B) is smaller than the target SH value (A) (S104). Then, if it is smaller, the control section 14 closes the downstream-side temperature-sensitive expansion valve 12 (S105). Conversely, if it is not smaller, the control section 14 does not perform any operation for the downstream-side temperature-sensitive expansion valve 12 (S106).

Next, control operation by the suction-side supercooling control section 15 is described. As the control operation starts (S201), it is decided whether or not the current SH value (D) is greater than the target SH value (C) (S202). If it is greater, the control section 15 opens the upstream-side temperature-sensitive expansion valve 12 (S203). Conversely, if it is not greater, it is decided whether or not the current SH value (D) is smaller than the target SH value (C) (S204). Then, if it is smaller, the control section 15 closes the upstream-side temperature-sensitive expansion valve 12 (S205). Conversely, if it is not smaller, the control section 15 does not perform any operation for the upstream-side temperature-sensitive expansion valve 12 (S206).

As shown above, the downstream-side supercooling-use expansion part 12 is controlled by the discharge-side supercooling control section 14, while the upstream-side supercooling-use expansion part 12 is controlled by the suction-side supercooling control section 15. Therefore, the two supercooling-use expansion parts 12, 12 can be controlled based on different temperatures and pressures, respectively.

Thus, in the two supercooling-use expansion parts 12, 12, hunting of the opening and closing operations due to control exerted based on a common temperature and pressure can be avoided so that a stable cooling effect can be obtained. For instance, in a case where the two supercooling-use expansion parts 12, 12 are controlled by the discharge-side supercooling control section 14, the two supercooling-use expansion parts 12, 12 are controlled by a common pressure and temperature, so that the opening and closing operations may undergo occurrence of hunting, where a stable cooling effect could not be obtained.

Without being limited to the above-described embodiment, the present invention may be subject to design changes within the scope of the invention unless they depart therefrom. It is also possible, for example, that upstream-side supercooling-use expansion part 12 is controlled by the discharge-side supercooling control section 14 while the downstream-side supercooling-use expansion part 12 is controlled by the suction-side supercooling control section 15 additionally provided on the downstream-side sub passage 11. Also, the sub passage 11, the supercooling-use expansion part 12 and the supercooling-use heat exchanger 13 may be provided each three or more in number, in which case one supercooling-use expansion part 12 is controlled by the discharge-side supercooling control section 14, and the other supercooling-use expansion parts 12 are controlled by the suction-side supercooling control sections 15 provided on the sub passages 11, respectively.

What is claimed is:

1. A refrigeration apparatus comprising:

a single screw compressor including a screw rotor and two gate rotors which mesh with the screw rotor so as to sandwich the screw rotor from both sides;

a condenser operatively connected to the compressor;

an expansion part operatively connected to the condenser;

an evaporator operatively connected between the expansion part and the compressor, the compressor, the condenser, the expansion part and the evaporator being connected to one another in a loop;

a plurality of sub passages branched from a main passage located between the condenser and the expansion part and connected to the compressor, a first one of the sub passages being connected to a compression chamber located on one side of a boundary defined by the gate rotors, and a second one of the sub passages being connected to a compression chamber located on another side of the boundary defined by the gate rotors;

a plurality of supercooling-use expansion parts with a first of the supercooling-use expansion parts being provided on the first sub passage and a second of the supercooling-use expansion parts being provided on the second sub passage;

a plurality of supercooling-use heat exchangers with each one of the supercooling-use heat exchangers performing heat exchange between refrigerant on an outlet side of one of the supercooling-use expansion parts and refrigerant of the main passage;

a discharge-side supercooling control section configured to detect temperature and pressure of a refrigerant on a discharge side of the compressor and control an opening degree of the supercooling-use expansion part in the first one of the sub passages based on the detection; and a suction-side supercooling control section configured to detect temperature and pressure of a refrigerant on a suction side of the compressor in the second one of the sub passages and control an opening degree of the supercooling-use expansion part in the second one of the sub passages, the supercooling-use expansion parts on the first and second sub passages being controlled based on different temperatures and pressures, respectively; and the first sub passage branches from the main pipe to the first supercooling-use expansion part at a location downstream of where the second sub passage branches from the main pipe to the second supercooling-use expansion part.

2. The refrigeration apparatus according to claim 1, wherein the supercooling heat exchangers and the first sub passage are arranged so that the refrigerant in the main pipe exchanges heat with the refrigerant in the first sub passage before the refrigerant in the main pipe branches to the first sub passage.

3. The refrigeration apparatus according to claim 2, wherein the supercooling heat exchangers and the second sub passage are arranged so that the refrigerant in the main pipe exchanges heat with the refrigerant in the second sub passage before the refrigerant in the main pipe branches to the second sub passage.

4. The refrigeration apparatus according to claim 1, wherein the supercooling heat exchangers and the second sub passage are arranged so that the refrigerant in the main pipe exchanges heat with the refrigerant in the second sub passage before the refrigerant in the main pipe branches to the second sub passage.

5. The refrigeration apparatus according to claim 1, wherein the discharge-side supercooling control section is configured to detect temperature and pressure of the refrigerant between the discharge side of the compressor and an intake side of the condensor; and the suction-side supercooling control section is configured to detect temperature and pressure of the refrigerant between the suction side of the compressor and an outlet of the second supercooling-use expansion part.

6. The refrigeration apparatus according to claim 5, wherein the discharge-side supercooling control section is configured to control the opening degree control of the first supercooling-use expansion part by calculating a present-time discharge-side degree of superheat from the temperature and the pressure of the refrigerant on the discharge side of the compressor and then comparing the calculated the present-time discharge-side degree of superheat with a previously set target discharge-side degree of superheat; and the suction-side supercooling control section is configured to control the opening degree control of the first supercooling-use expansion part by calculating a present-time suction-side degree of superheat from the temperature and the pressure of the refrigerant on the suction side of the compressor and then comparing the calculated the present-time suction-side degree of superheat with a previously set target suction-side degree of superheat.

7. The refrigeration apparatus according to claim 6, wherein the discharge-side supercooling control section is configured to control the opening degree control of the first supercooling-use expansion part independently of the temperature and the pressure of the refrigerant detected on the suction side of the compressor; and the suction-side supercooling control section is configured to control the opening degree control of the first supercooling-use expansion part independently of the temperature and the pressure of the refrigerant detected on the discharge side of the compressor.

8. The refrigeration apparatus according to claim 1, wherein the discharge-side supercooling control section is configured to control the opening degree control of the first supercooling-use expansion part by calculating a present-time discharge-side degree of superheat from the temperature and the pressure of the refrigerant on the discharge side of the compressor and then comparing the calculated the present-time discharge-side degree of superheat with a previously set target discharge-side degree of superheat; and the suction-side supercooling control section is configured to control the opening degree control of the first supercooling-use expansion part by calculating a present-time suction-side degree of superheat from the temperature and the pressure of the refrigerant on the suction side of the compressor and then comparing the calculated the present-time suction-side degree of superheat with a previously set target suction-side degree of superheat.

9. The refrigeration apparatus according to claim 1, wherein the discharge-side supercooling control section is configured to control the opening degree control of the first supercooling-use expansion part independently of the temperature and the pressure of the refrigerant detected on the suction side of the compressor; and the suction-side supercooling control section is configured to control the opening degree control of the first supercooling-use expansion part independently of the temperature and the pressure of the refrigerant detected on the discharge side of the compressor.

* * * * *